US008113090B1

(12) United States Patent
Lorence

(10) Patent No.: US 8,113,090 B1
(45) Date of Patent: Feb. 14, 2012

(54) BOTTLE, CAP, AND CAP-REMOVER ASSEMBLY AND ITS METHOD OF OPERATION

(76) Inventor: Adam S Lorence, Newtown, PA (US)

( * ) Notice: Subject to any disclaimer, the term of this patent is extended or adjusted under 35 U.S.C. 154(b) by 157 days.

(21) Appl. No.: 12/540,237

(22) Filed: Aug. 12, 2009

Related U.S. Application Data

(63) Continuation-in-part of application No. 12/037,539, filed on Feb. 26, 2008, now abandoned.

(51) Int. Cl.
*B67B 7/16* (2006.01)

(52) U.S. Cl. ..... 81/3.55; 215/304; 81/3.36; 81/3.57

(58) Field of Classification Search ..... 215/304, 215/303, 309, 295, 46; D8/18, 33; 81/3.55, 81/3.36, 3.57, 3.27
See application file for complete search history.

(56) References Cited

U.S. PATENT DOCUMENTS 1,150,160 A * 8/1915 Allison ..... 81/3.36
1,250,448 A * 12/1917 Green ..... 81/3.36
1,346,621 A * 7/1920 Whitaker ..... 81/3.36
1,530,810 A * 3/1925 Bracey ..... 81/3.57
2,014,753 A * 9/1935 Weber ..... 81/3.36
2,046,173 A 6/1936 Lenhoff
4,453,644 A 6/1984 Berglund

* cited by examiner

*Primary Examiner* — Hadi Shakeri
(74) *Attorney, Agent, or Firm* — LaMorte & Associates P.C.

(57) ABSTRACT

An assembly that includes a bottle, a bottle cap and a tool for removing the bottle cap. A pry tool is provided having a lever tab, a thumb tab and a prying catch. A flexible restraint is used to attach the pry tool to the neck of the bottler. The flexible restraint passes into a groove formed in part by the presence of the bottle cap. The pry tool is free to rotate about the connection point between an engaged position, wherein the pry tool engages the cap, and a disengaged position wherein the pry tool is disengaged from the cap. When the pry tool is in its engaged position, the pry tool will pry open the cap when an upward force is applied to the thumb tab of the pry tool. This configuration enables a container to be held in one hand and opened.

6 Claims, 8 Drawing Sheets

BOTTLE, CAP, AND CAP-REMOVER ASSEMBLY AND ITS METHOD OF OPERATION

RELATED APPLICATIONS

This application is a Continuation-In-part of application Ser. No. 12/037,539, entitled Cap Removal Device Attached To A Container, filed Feb. 26, 2008 now abandoned.

BACKGROUND OF THE INVENTION

1. Field of the Invention

In general, the present invention relates to the structure of bottle cap openers that are used to remove crimped caps from beverage containers. More specifically, the present invention relates to assemblies where a bottle cap opener is attached to a bottle cap or the neck of a beverage container proximate the cap.

2. Prior Art Description

Glass bottles have been used to hold liquid products for hundreds of years. In this long period of time, the glass bottle has evolved very little. However, the devices used to cap the glass bottle have undergone many changes.

Prior to the twentieth century, a liquid product was typically held within a glass bottle using a cork. Although the cork worked well as a cap, it requires a corkscrew for removal. Furthermore, cork wood is expensive and cork caps are difficult to apply to bottles.

In the early part of the twentieth century, many liquid consumer products that were packaged in bottles began to use crimped metal caps. Crimped metal caps were inexpensive and were easier to assemble in an automated factory. Furthermore, crimped metal caps provided better seals to a bottle than did corks. Additionally, although crimped metal caps required a tool to be removed from a bottle, it was far easier to remove a crimped metal cap from a bottle than it is to remove a cork.

By the second half of the twentieth century, twist-off metal caps began to replace crimped metal caps. Twist-off metal caps can be manually removed from a bottle without the use of a bottle cap opening tool. Although metal twist-off caps are more practical than crimped metal caps, twist-off caps have only become popular on the bottle containers of low cost and mass-produced beverages. Manufacturers of high-end beverages and custom market beverages still tend to use crimped metal caps. Crimped metal caps provide a beverage container with a sense of quality that is important to both the beverage manufacturer and the beverage consumer.

In the prior art, crimped metal caps have been designed that can be removed without the need of a bottle cap opener. In such prior art designs, a lever is typically affixed directly to the bottle cap. In this manner, when the lever is pulled upwardly, the crimped metal cap deforms and disengages from the bottle. Such prior art bottle cap designs are exemplified by U.S. Pat. No. 4,453,644 to Berglund, entitled Cap With Tear-Off Tag and U.S. Pat. No. 2,046,173 to Lenhoff, entitled Bottle Cap Remover.

Specialized crimped bottle caps with attached pry levers have a tendency to accidentally open as the levers are contacted during shipping and handling. Furthermore, such specialized crimped bottle caps are expensive to make and have become impractical after the introduction of the lower cost twist-off cap.

The present invention is a crimped cap removal device that attaches to the neck of a beverage container. The cap removal device enables a crimped bottle cap to be removed from a bottle without the use of a secondary tool. It further enables a bottle with a crimped bottle cap to be opened with one hand, while providing a strong cap that will not inadvertently open during handling. The details of the present invention cap removal device are described and claimed below.

SUMMARY OF THE INVENTION

The present invention is an assembly that includes a bottle, a bottle cap and a tool for removing the bottle cap. The bottle has two flange rings close to its open end. The cap crimps to the upper ring. The cap used to seal the container has a flat top surface and a peripheral wall that extends downwardly from the flat top surface. The peripheral wall is crimped to attach the cap to the container. The peripheral wall terminates along a bottom edge that must be pried up in order to remove the cap from the container. Once the cap is crimped to the upper ring, a groove is formed between the bottom of the cap and the second, lower ring.

A pry tool is provided having a lever tab, a thumb tab and a prying catch. A flexible restraint is used to attach the pry tool to the neck section of the container. The flexible restraint lies within the groove under the cap. The pry tool connects to the flexible restraint from at least one connection point. The pry tool is free to rotate about the connection point between an engaged position, wherein the pry tool engages the cap, and a disengaged position wherein the pry tool is disengaged from the cap.

When the pry tool is in its engaged position, the pry tool will pry open the cap when an upward force is applied to the thumb tab of the pry tool. This configuration enables a container to be held in one hand while the pry tool is positioned and activated with the thumb of the same hand.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention cap removal assembly can be used in conjunction with many types of containers that have crimped caps, the present invention is especially well suited for use in removing crimped caps from glass beverage containers. Accordingly, the exemplary embodiment of the present invention cap removal assembly is shown in conjunction with a glass beverage container in order to set forth the best mode contemplated for the invention. However, it will be understood that the scope of the invention is intended to cover containers of all types and the illustrated embodiment should not be considered a limitation upon the claims.

Figure 1:
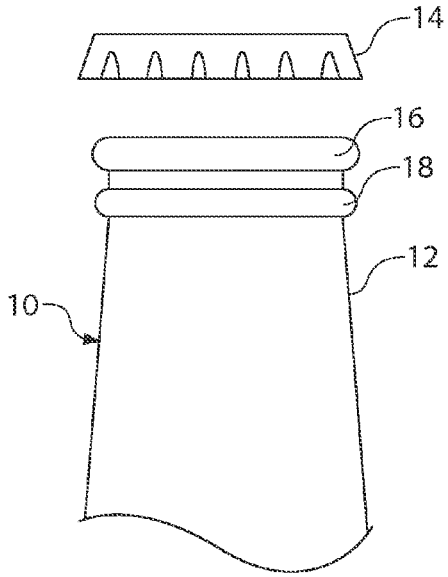
FIG. 1 (PRIOR ART)
FIG. 1 is a fragmented side view of a prior art bottle with a separated cap.
Figure 2:
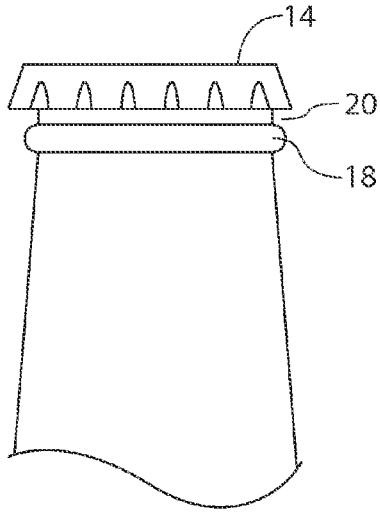
FIG. 2 (PRIOR ART)
FIG. 2 is a fragmented side view of a prior art bottle with a connected cap.

Referring to FIG. 1 and FIG. 2, the neck 12 and cap 14 of a traditional glass bottle container 10 is shown. Such glass bottle containers 10 typically have an elongated neck 12. At the top of the neck 12, two radial rings 16, 18 are formed into the glass of the bottle container 10. The two radial rings include an upper ring 16 and a lower ring 18.

The upper ring 16 on the glass bottle container is used to engage the bottle cap 14. The bottle cap 14 crimps around the structure of the upper ring 16. As such, a crimp bottle cap 14 could not be used on the glass bottle container 10 if the upper ring 16 were not present.

The lower ring 18 serves two functions. First, the lower ring 18 has a diameter generally equal to the diameter of the crimped bottle cap 14. As such, the lower ring 18 serves as a physical barrier that prevents contact to the bottom of the crimped bottle cap 14 during shipping and handling.

Second, the lower ring 18 provides a protruding surface, other than the crimped bottle cap 14, that can be engaged by processing machinery within an automated bottling facility.

Due to the functionality of the upper ring 16 and the lower ring 18, most every glass bottle container 10 for beverages in the United States contains both the upper ring 16 and the lower ring 18. As can be seen from FIG. 2, when a bottle cap 14 is crimped to a glass bottle container 10, a depressed groove 20 is present on the glass bottle container 10. The depressed groove 20 is defined between the upper barrier of the crimped bottle cap 14 and the lower barrier of the lower ring 18. The diameter of the bottled neck 14 within the depressed groove 20 is at least 1/32 of an inch smaller than the diameter of either the crimped bottle cap 14 or the lower ring 18.

Referring to FIG. 2 in conjunction with both FIG. 3 and FIG. 4, it can be seen that a cap removal assembly 21 is attached to the neck 12 of a beverage container 10 just below a crimped bottle cap 14 that seals the beverage container 10. As will be later explained, the cap removal assembly 21 can be flipped up into engagement with the crimped bottle cap 14 using only one finger. Once engaged with the crimped bottle cap 14, the cap removal assembly 21 can be used to remove the crimped bottle cap 14, again using only one finger. In this manner, a person can both grasp and open the beverage container 10 with only one hand.

The cap removal assembly 21 includes a pry tool 23 and a flexible restraint 22 that holds the pry tool 23 in place against the neck 12 of the container 14. The pry tool 23 is preferably made of metal, so as to be strong and rigid. The pry tool 23 is preferably stamped from a single piece of sheet metal and bent, in part, into the form of the pry tool 23 herein described.

The pry tool 23 has a planar section 25 that extends between a first end 24 and a second end 26. A prying catch 30 extends downwardly from the planar section 25 from a bend line 28 that is close to the midpoint of the planar section 25. The planar section 25 forms a thumb tab 32 between the first end 24 of the planar section 25 and the bend line 28. Likewise, the planar section 25 creates a lever tab 34 between the bend line 28 and the second end 26 of the planar section 25.

The prying catch 30 is created by a section of the pry tool 23 that is bent downwardly at an angle of between 70 degrees and 100 degrees relative perpendicular to the planar section 25. The prying catch 30 includes two support arms 36 that extend downwardly from the planar section 25. The support arms 36 hold a lateral lift element 38 at opposite ends. The prying catch 30, created by the support arms 36 and the lateral lift element 38, defines the periphery of an opening 40.

Connection features 42 are formed into the structure of the prying catch 30. The connection features 42 enable the prying catch 30 to connect to the flexible restraint 22. The flexible restraint 22 passes around the neck 12 of the beverage container 14. The flexible restraint 22 passes into the groove 20 between the bottle cap 14 and the lower ring 18. The groove 20 receives the flexible restraint 22 and prevents the flexible restraint 22 from moving either up or down during processing, shipping and handling. Since the flexible restraint 22 is retained in a specific position by the groove 20, and since the flexible restraint 22 is coupled to the pry tool 23, the pry tool 23 in contact with the neck 12 of the beverage container 10 at a very precise location.

In the illustrated embodiment, the connection features 42 that join the flexible restraint 22 to the pry tool 23 are tabs 44. The flexible restraint 22 is a piece of plastic strapping 46 having apertures 48 at opposite ends. The tabs 44 pass into the apertures 48 and interconnect the prying catch 30 with the flexible restraint 22. The use of plastic strapping 46 and tabs 44 is only one of many ways to interconnect the pry tool 20 to the flexible restraint 22. Some alternate embodiments for this interconnection are later described.

In the illustrated embodiment, the tabs 44 that engage the plastic strapping 46 are located at the bottom of the prying catch 30. As such, the pry tool 23 is free to pivot about the bottom of the prying catch 30. This enables the pry tool 23 to rotated and engage the crimp cap 14.

Figure 3:
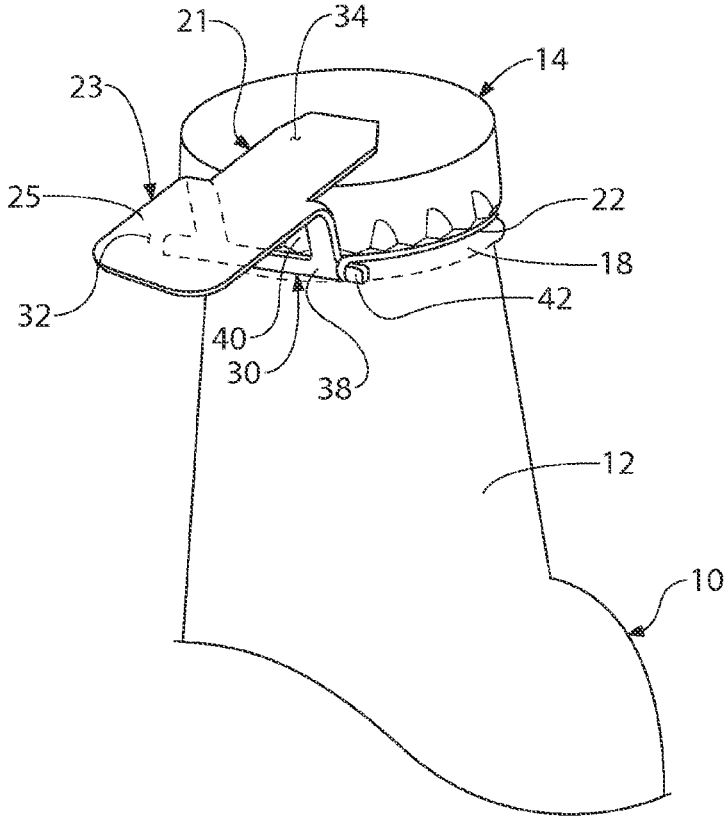
FIG. 3 is a perspective view of an exemplary embodiment of a cap removal assembly engaging a capped container.
Figure 4:
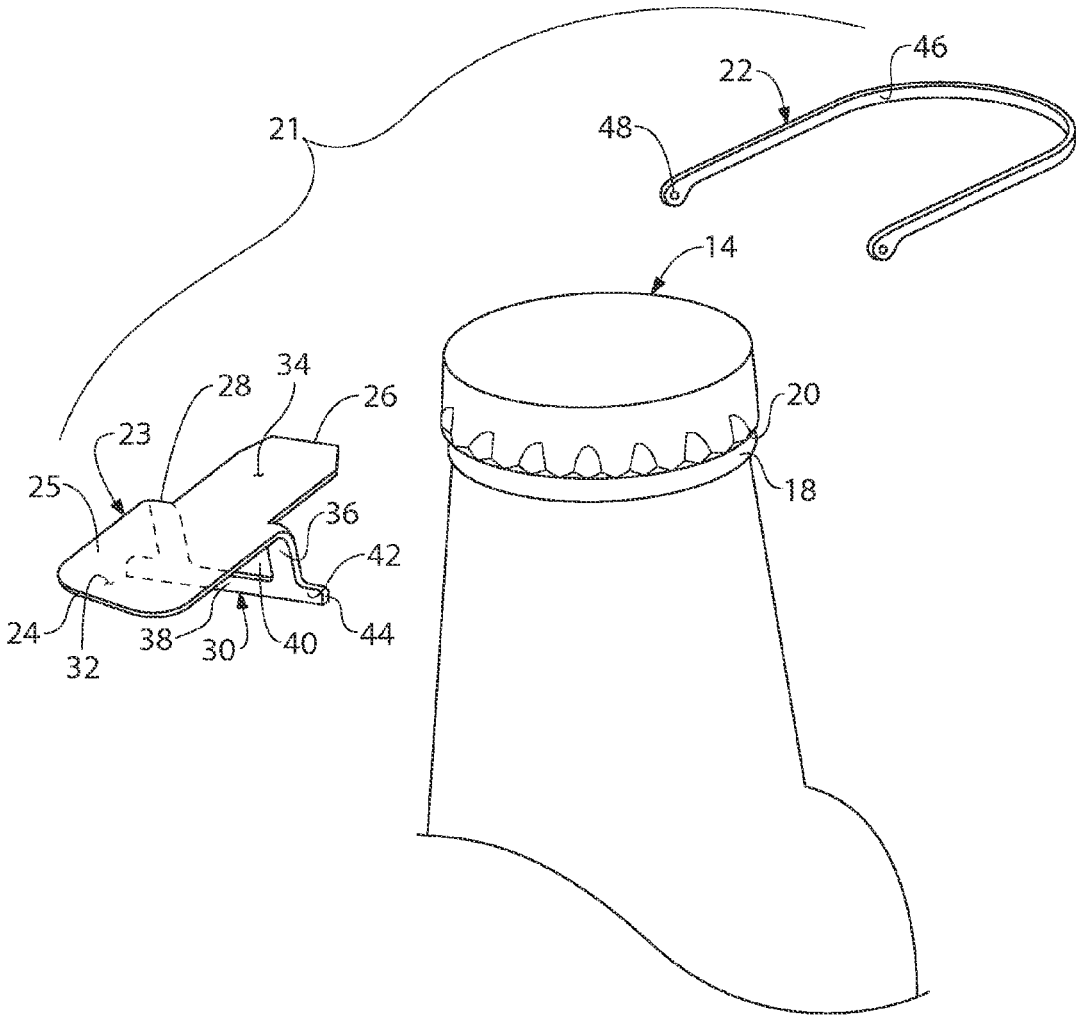
FIG. 4 is an exploded view of the embodiment of FIG. 1.
Figure 5:
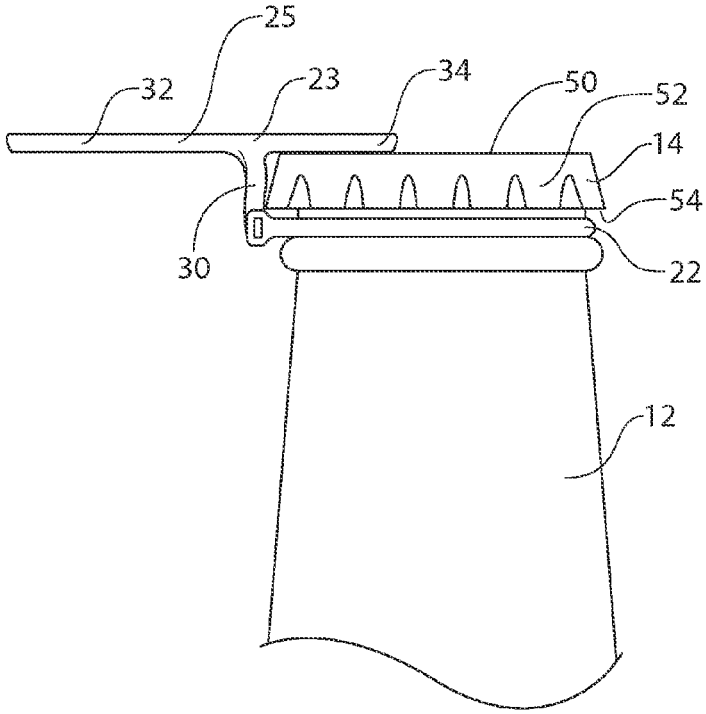
FIG. 5 is a side view of the exemplary embodiment with the pry tool shown in an engaged position.

Referring to FIG. 5 in conjunction with FIG. 3, the pry tool 23 is shown in an engaged configuration, wherein the pry tool 23 is engaging the crimped bottle cap 14 of the beverage container 10. When the pry tool 23 is in its engaged configuration, the planar section 25 of the pry tool 23 is parallel to the top surface 50 of the crimped cap 14. The lever tab 34 of the planar section 25 lays flat against the top surface 50 of the crimped bottle cap 14. The thumb tab 32 extends as a cantilever beyond the periphery of the crimped bottle cap 14.

The crimped bottle cap 14 has a peripheral wall 52 that extends downwardly from the top surface 50 of the crimped bottle cap 14. The peripheral wall 52 has a bottom edge 54. When the pry tool 23 is in its engaged configuration, the prying catch 30 passes around a portion of the peripheral wall 52, wherein that portion of the peripheral wall 52 passes into the opening 40 defined by the prying catch 30. Once in this engaged configuration, the lateral lift element 38 passes under the bottom edge 54 of the peripheral wall 52.

Figure 6:
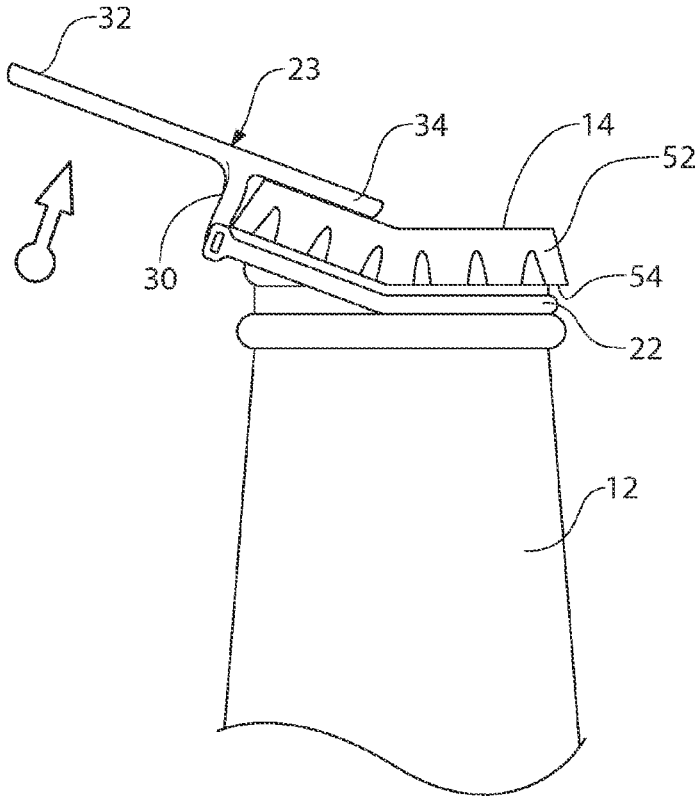
FIG. 6 is a side view of the exemplary embodiment with the pry tool shown removing a cap.

Referring to FIG. 6, it can be seen that when the pry tool 23 is in its engaged configuration and an upward force is applied to the thumb tab 32, the prying catch 30 lifts the bottom edge 54 of the peripheral wall 52 of the crimped bottle cap 14. Simultaneously, the lever tab 34 of the planar section 25 presses downwardly on the crimped bottle cap 14. These forces cause the crimped bottle cap 14 to fold and disconnect from the container 10. It is therefore understood that when an upward force is applied to the thumb tab 32, the pry tool 23 pries open the crimped bottle cap 14.

Figure 7:
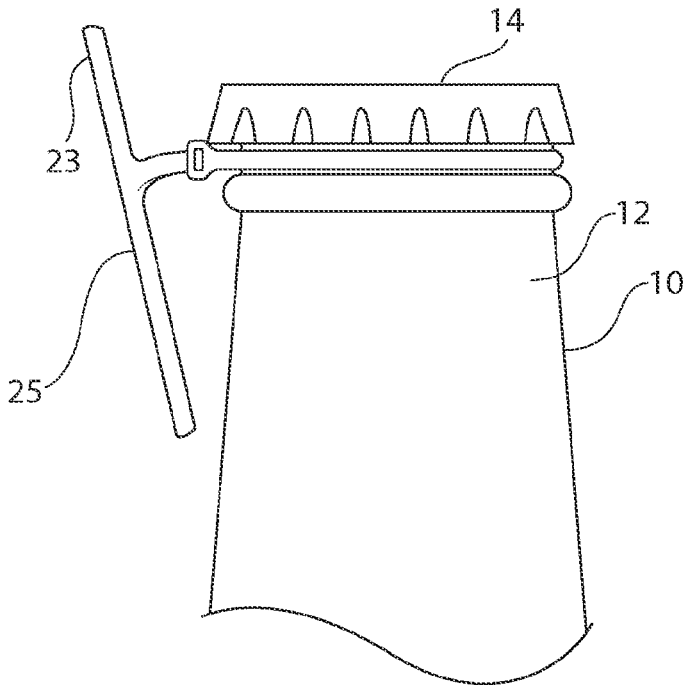
FIG. 7 is a side view of the exemplary embodiment with the pry tool shown in a disengaged position.

The pry tool 23 is not always in its engaged position. Referring to FIG. 7, it can be seen that the pry tool 23 is free to rotate about its connection points with the flexible restraint 22. Accordingly, the pry tool 23 can be rotated from the disengaged position of FIG. 7 to the engaged position of FIG. 5.

When in the disengaged position, the planar section 25 of the pry tool 23 turns to the side of the container's neck 12 and away from engagement with the crimped bottle cap 14. Likewise, the prying catch 30 rotates out of engagement with the crimped bottle cap 14. Accordingly, the pry tool 20 no longer engages the crimped bottle cap 14 and any accidental force applied to the pry cap 20 will have no effect upon removing or loosening the crimped bottle cap 14.

Referring to both FIG. 5 and FIG. 7, it will be understood that once the cap removal assembly 21 is attached to a container 10, the pry tool 23 is initially held in the disengaged position. When a person grabs the container 10, a person can flip the pry tool 23 from its disengaged position (FIG. 7) to its engaged position (FIG. 5) by just applying a small force to the thumb tab 32 sufficient enough to rotate the position of the pry tool 23. The pry tool 23 is held in a specific location by the passage of the flexible restraint 22 around the groove 20. Accordingly, the pry tool 23 is always in the proper position when flipped up. Once in the engaged position, a further force is applied to the thumb tab 32 to cause the pry tool 23 to bend the crimped cap 16. The rotation of the pry tool 20 from the disengaged position to the engaged position, as well as the application of the force needed to open the crimped bottle cap 14, can both be applied by the thumb of the hand holding the beverage container 10. It will therefore be understood that the cap removal assembly 21 enables the beverage container 10 to be held and simultaneously opened with a single hand.

From the described use of the cap removal assembly 21, it will be understood that the flexible restraint 22 has two functional purposes. First, the flexible restraint 22 holds the pry tool 20 in place along the groove 20 of the beverage container 10. Second, the connection points of the flexible restraint 22 provide the pivots needed to flip the pry tool 23 between its engaged position and its disengaged position.

Figure 8:
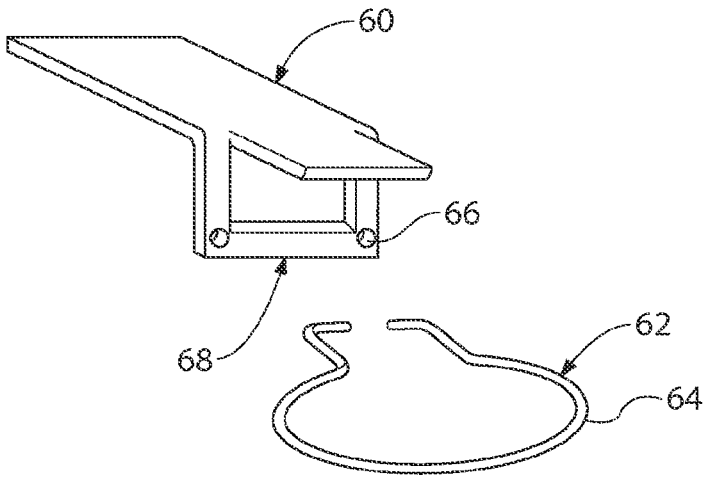
FIG. 8 is a perspective view of a second exemplary embodiment of a cap removal assembly.

Referring to FIG. 8, an alternate embodiment of a flexible restraint and a pry tool 60 are shown. In this embodiment, the flexible restraint 62 is a wire 64. The wire 64 passes through holes 66 punched in the prying catch 68 of the pry tool 60.

Figure 9:
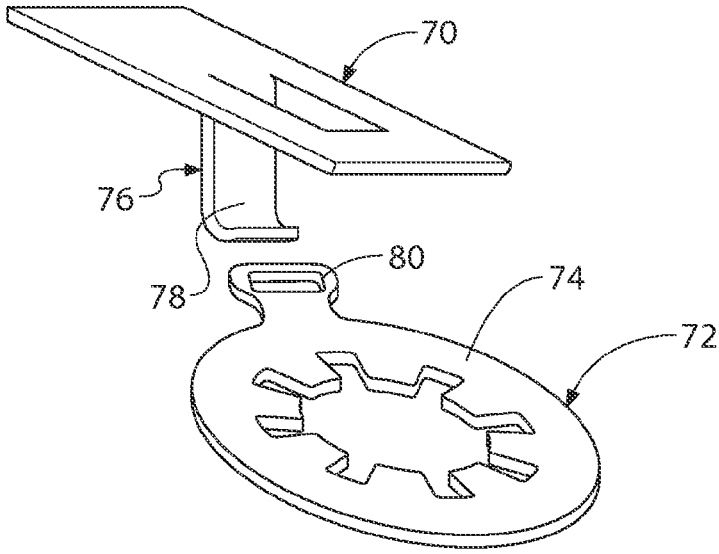
FIG. 9 is a perspective view of a third exemplary embodiment of a cap removal assembly.

Referring to FIG. 9, a second alternate embodiment of a restraint and a pry tool 70 are shown. In this embodiment, the restraint 72 is an annular plastic stamping 74 that slides onto the neck of the beverage container. The prying catch 76 is configured as a J-shaped pawl 78. A prying catch 76 of such a configuration is easily made from stamping a piece of sheet metal. A slotted tab 80 extends from the annular plastic stamping 74. The prying catch 76 passes into the slotted tab 80, thereby joining the restraint 72 to the pry tool 70.

The embodiments of FIG. 8 and FIG. 9 are provided to illustrate that the restraint and the pry tool can take many forms. What is important is that the restraint connects the pry tool to the neck of a container in a way that enables the pry tool to selectively pivot between an engaged position and a disengaged position.

It will be understood that the embodiments of the present invention that are illustrated and described are merely exemplary and that a person skilled in the art can produce many different embodiments using functionally equivalent components. All such variations, modifications, and alternate embodiments are intended to be included within the scope of the present invention as defined by the claims.

What is claimed is:

1. An assembly, comprising:

a bottle container having a neck terminating with an opening, wherein said neck includes an upper radial ring and a lower radial ring proximate said opening;

a cap crimped closed over said upper radial ring on said neck to seal said opening, said cap having a flat top surface, and a peripheral wall that extends downwardly from said flat top surface to a bottom edge, wherein a groove is defined on said neck of said bottle container between said bottom edge of said cap and said lower radial ring;

a pry tool having a lever tab, a thumb tab and a prying catch that are rigidly interconnected, wherein said lever tab and said thumb tab are parts of a common planar surface, the prying catch including at least one support arm extending downwardly form a bend line between the lever tab and the thumb tab and a lateral lift element supported by said at least one support arm; and a flexible restraint that extends from said lift element from at least one connection point defined by a free end of said lift element, said flexible restraint extending around said neck of said bottle container within said groove and holding said pry tool against said neck section of said container;

wherein said pry tool is free to rotate about said at least one connection point between an engaged position and a disengaged position;

wherein when in said engaged position, said lever tab lays flat against said top surface of said cap, said thumb tab extends as a cantilever away from said cap and said prying catch engages said bottom edge of said peripheral wall of said cap; and wherein when in said disengaged position, said lever tab is disengaged from said cap.

2. The assembly according to claim 1, wherein said pry tool is a single stamped piece of metal.

3. The assembly according to claim 1, wherein said flexible restraint is an annular plastic ring.

4. The assembly according to claim 1, wherein said flexible restraint is elastic and biases said pry tool against said neck section of said container.

5. The assembly according to claim 1, wherein said flexible restraint is a length of a flexible tether.

6. A method comprising the steps of:

providing a bottle container having a neck, wherein an upper ring and a lower ring are formed on said neck;

crimping a cap to said upper ring, said cap having a flat top surface, and a peripheral wall that extends downwardly from said flat top surface, wherein said peripheral wall terminates along a bottom edge, wherein a groove is defined on said neck of said bottle container between said bottom edge of said cap and said lower radial ring;

providing a pry tool having a lever tab, a thumb tab and a prying catch that are rigidly interconnected, wherein said lever tab and said thumb tab are parts of a common planar surface, the prying catch including at least one support arm extending downwardly form a bend line between the lever tab and the thumb tab and a lateral lift element supported by said at least one support arm; and attaching said lift element by at least one connection point defined by a free end of said lift element to a flexible restraint that extends around said neck in said groove, wherein said pry tool is free to rotate between an engaged position and a disengaged position;

wherein when in said engaged position, said lever tab lays in abutment against said top surface of said cap and said prying catch engages said bottom edge of said peripheral wall of said cap; and wherein when in said disengaged position, said lever tab is disengaged from said cap.

* * * * *